US005495952A

United States Patent [19]

Kainz

[11] Patent Number: 5,495,952

[45] Date of Patent: Mar. 5, 1996

[54] SHOP OR EXHIBITION FITTINGS

[75] Inventor: Kurt Kainz, Them, Denmark

[73] Assignee: AM System Silkeborg A/S, Them, Denmark

[21] Appl. No.: 223,749

[22] Filed: Apr. 6, 1994

[51] Int. Cl.[6] ..... A47F 5/08

[52] U.S. Cl. ..... 211/90; 52/36.6; 52/239

[58] Field of Search ..... 211/90, 87, 103, 211/26; 160/135; 248/243; 52/36.4, 36.5, 36.6, 220.2, 220.7, 239; 108/108, 110, 111

[56] References Cited

U.S. PATENT DOCUMENTS

| | | | |
|---|---|---|---|
| 2,665,869 | 1/1954 | Samuels | 211/87 X |
| 2,969,565 | 1/1961 | Levy | 52/239 X |
| 3,517,623 | 6/1970 | Goldstein et al. | 248/243 X |
| 3,648,419 | 3/1972 | Marks | 52/36.6 |
| 3,788,378 | 1/1974 | Sobel | 160/135 |
| 3,802,146 | 4/1974 | Tacke et al. | 52/220.7 X |
| 3,958,372 | 5/1976 | Benbow | 52/36.6 |
| 4,581,859 | 4/1986 | Doke et al. | 52/36.6 |
| 4,588,156 | 5/1986 | Doke et al. | 52/36.6 X |
| 4,631,881 | 12/1986 | Charman | 160/135 X |
| 4,828,005 | 5/1989 | Notley | 160/135 X |

FOREIGN PATENT DOCUMENTS 163407 8/1984 Denmark .

*Primary Examiner*—David M. Purol
*Attorney, Agent, or Firm*—Antonelli, Terry, Stout & Kraus

[57] ABSTRACT

A shelf and wall system in accordance with the invention includes a plurality of shelf carrier posts having suspension apertures in at least three sides thereof, a plurality of shelves having associated brackets for mounting in selected apertures of the posts, transverse carrier rods for mounting between neighboring posts in engagement with the apertures, and a plurality of wall elements having suspension hooks for engaging the carrier rods, the wall panel elements having a width larger than a distance between the posts so as when suspended to rest against outermost front side portions of its associated posts. The wall panel elements having a height measured between their lower edges and their suspension hooks for engaging such that the wall panels are mounted in suspended positions with their lower edges located at or above a top side plane of underlying shelves.

8 Claims, 2 Drawing Sheets

SHOP OR EXHIBITION FITTINGS

The present invention relates to shop or exhibition fittings and more specifically, though not exclusively, to a shelf system for the exhibition of radio and TV sets or other electrical devices which are wanted to be exhibited in operating condition, i.e. which are to be electrically connected while standing on their shelves. This leads to the well known problem that the required associated cables are difficult to hide, so in many cases it is accepted that an otherwise neat exhibition is more or less spoiled by the exposed bundles of cables.

DESCRIPTION OF THE PRIOR ART

It has already been proposed to arrange for a rear double wall, such that the cables can be hidden in the space between these walls, but the known systems have been rather expensive and also are difficult in use, e.g. when a TV-set is to be taken down from its shelf together with the associated electrical supply cable.

SUMMARY OF THE INVENTION

On this background it is the purpose of the invention to provide a shelf system that is simple and inexpensive in production and mounting and is well suited to hide the cables in such a manner that the cables are nevertheless easy to access.

The system according to the invention is based on the use of ordinary shelf carrier posts having longitudinal rows of holes or slots in at least three sides thereof. These posts may be wall mounted with a predetermined spacing, such that their front sides will be readily usable for receiving shelf carrier brackets in a fully conventional and easy manner. The holes or slots in the side walls of the posts are used for mounting-in, between each pair of neighbouring posts, a number of horizontal carrier rods, which, each, is operable to releasably support suspension means fastened to a front cover plate dimensioned so as to horizontally fill out the space between the neighbouring posts in front of the rear mounting wall, while vertically the cover plate projects from the bottom level of a shelf down to slightly above the bottom level of the underlying shelf. From this it results that at the rear of a given shelf there will be an open slot between the top edge of the underlying cover plate and the bottom edge of the overlying cover plate, and the cables can be drawn through this slot so as to be hidden therebehind. The cover plate elements will be individually associated with the space above the rear of each shelf, and when they are easily and individually releasable from that position it will be relatively easy to rearrange the hidden cables in connection with an addition or a removal of an exhibited device to or from a given shelf.

The desired open space between the rear mounting wall and the cover plate elements may be visible through the said slots between the cover plates, and in a high quality system this may be undesirable. In connection with the invention, however, it is easy to obviate this situation, inasfar as it is possible to arrange, between the side holes of the vertical posts, horizontal covering means preventing a full sight through the slots. In a preferred embodiment such means will be constituted already by the carrier rod means for carrying the underlying cover plate element.

The cover plate elements, positioned with small mutual spacing, will provide a generally unbroken rear wall surface of the shelf system. They can carry various advertising inscriptions, and they can even be made as translucent elements having a frame structure with a translucent plate that can be illuminated by a lamp housed in the space between the rear mounting wall and the wall made of the plate elements.

BRIEF DESCRIPTION OF THE DRAWINGS

In the following the invention is described in more detail with reference to the drawing, in which.

DESCRIPTION OF THE PREFERRED EMBODIMENTS

Figure 1:
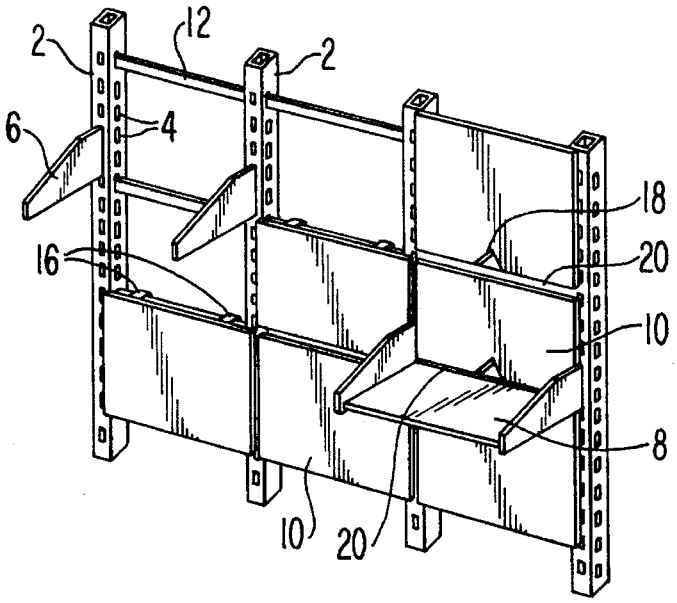
FIG. 1 is a perspective view of a shelf system according to the invention.

In FIG. 1 is shown a system of four wall mounted posts 2 of the type having holes or slots (apertures) 4 at all four sides or at least at three sides. Shelf brackets 6 for shelves 8 can be mounted wherever desired, but as indicated it is preferred to arrange the shelves in a regular pattern, each with a rectangular rear wall element 10.

The wall elements 10, which may be plate members of wood or any other material, are mounted in an easily detachable manner, simply in being suspended on transverse carrier rods 12 mounted between opposed side holes 4 in the respective pairs of posts 2, the rods 12 having notches 14 to interlock with the hole edges. The wall elements are provided with rear hook members 16, of which the hook portions for engaging the rods 12 are spaced behind the rear side of the wall elements 10 corresponding to half the thickness of the posts 2, such that the wall elements 10 in their suspended position (see FIG. 3) will be able to hang with their side edge portions flat against the front side of the posts 2, the width of the wall elements being adjusted correspondingly. Thus, the wall elements 10 should be broad enough to engage the outermost front side portion of the posts, yet without covering the holes 4 in these front sides.

The shelf and wall system so far disclosed will be generally applicable, e.g. with the possibility of changing out the wall elements with elements of other colours or inscriptions. As mentioned, however, the system is particularly applicable for the exhibition of cable connected units because the cables may generally be hidden in the space behind the wall elements 10, with only the required cable ends being drawn to the single shelves from the rear ends thereof. In FIG. 1 it is suggested that the lower edge of the wall elements 10—or one or more of them—may be provided with a notch 18 for the throughlet of cables to or from the associated shelf. At the rear side of the wall element 10 may be provided a loose plate member covering the notch 18, but guided such that it can be pushed upwardly to provide for the required space for the cables and to prevent a through-sight through the still open part of the notch.

It is a preferred measure, however, that the wall elements 10 are dimensioned such that in their mounted positions there will remain a slot 20 between their lower edge and the top edge of the underlying wall element, so that these slots will be located along the top side level of the associated shelves to accommodate the required cables 22.

Figure 3:
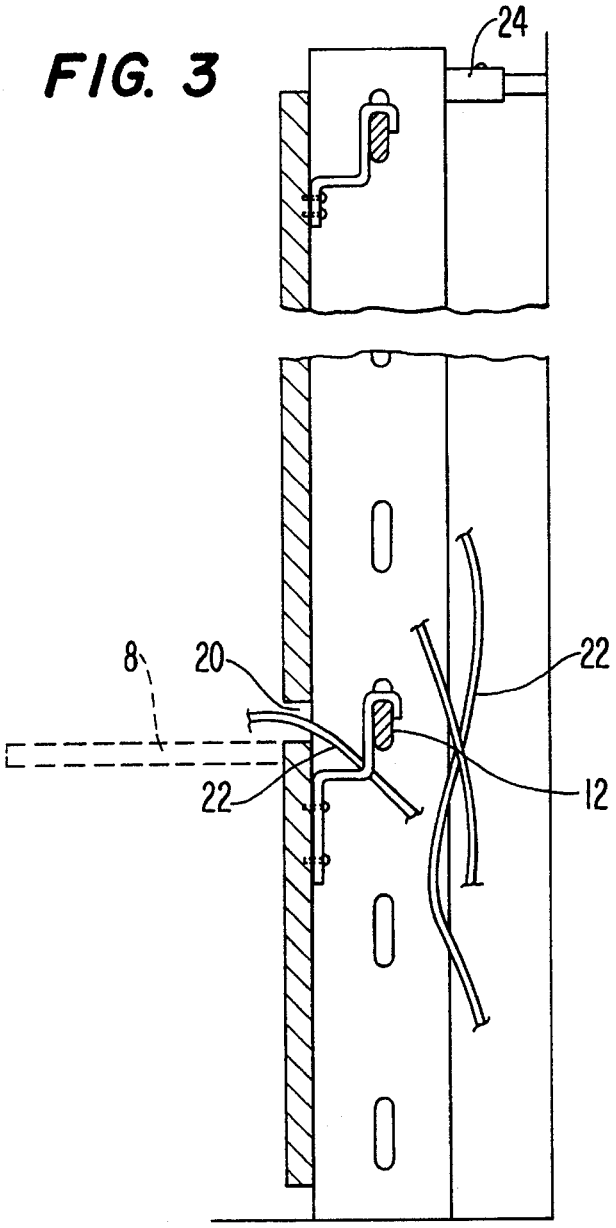
FIG. 3 is a lateral view of the system.

In a high quality system it will be undesirable to use slots 20 that provide sight to the space behind the wall elements 10, but it will be noted from FIG. 3 that the carrier rod or beam 12 of the underlying wall element is located just behind the slot 20, thus preventing further sight while leaving sufficient space for the cables to pass to or from the slot 20.

This arrangement provides for the carrier beam 12 to be located above the top of each wall element 10. At the top of the entire system these beams may be visible. For this reason it is preferred that the uppermost wall elements 10 be made with additional height so as to visually hide the uppermost carrier beams as illustrated at the top of FIG. 3.

Figure 2:
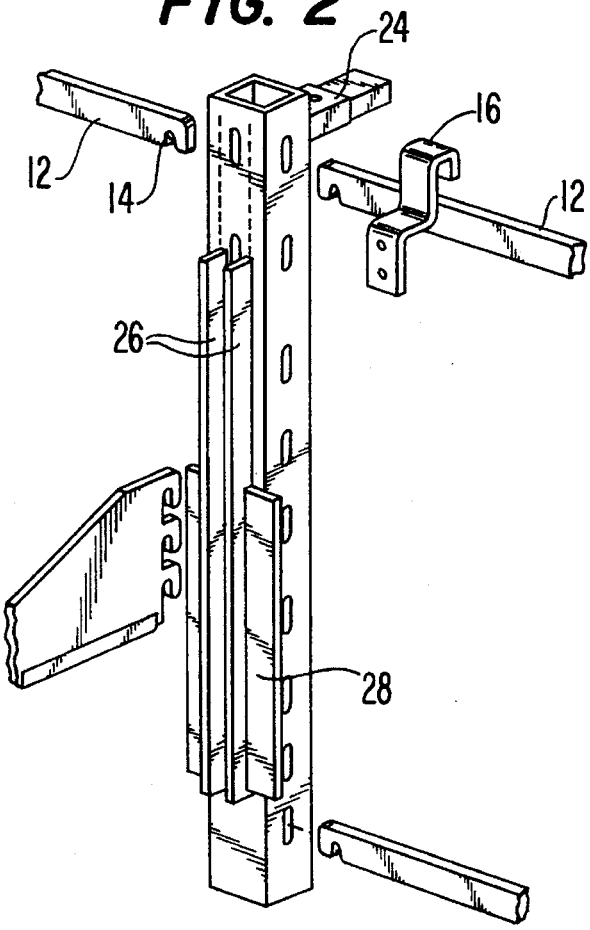
FIG. 2 is a perspective view of some of the basic parts thereof.
Figure 4:
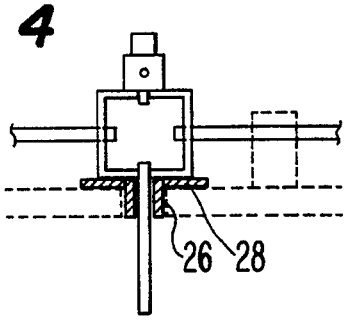
FIG. 4 is a top view of a carrier post thereof.

The posts 2 should preferably not be mounted directly against a wall, as it is desirable that cables 22 can pass behind the posts. In a preferred design, therefore, the posts are provided with top mounted, horizontal distance members 24, which, as indicated in FIGS. 2, 3 and 4, may even be telescopic elements for adjustment conform to irregularities in the mounting wall. If there are holes 4 also in the rear side of the posts, the members 24 may be arranged to be hooked into such holes as shown in FIG. 4.

For ensuring a neat alignment of the wall elements it is preferable to provide the posts 2 with outstanding rib portions 26, as illustrated in FIG. 2, along the row of front holes 4, such that between these ribs there is space for the shelf brackets 6, while at their outer sides the ribs will cover the edges of the wall elements and prevent them from being laterally displaced. In a preferred embodiment as illustrated in the lower half of FIG. 2 and in FIG. 4 the ribs 26 are provided as angle iron wings 28, the wings being mounted on the front side of the posts so as to project laterally therefrom, whereby the side edge areas of the wall elements 10 will have enlarged abutment or support surfaces. In that case, of course, the hook members 16 should be adapted to a correspondingly increased distance between the carrier beams 12 and the supporting front side of the posts 2.

I claim:

1. A shelf and wall system comprising a plurality of shelf carrier posts having suspension apertures in at least three sides thereof, a plurality of shelves having associated brackets for mounting in selected front apertures of said posts, transverse carrier rods for mounting between neighbouring posts in engagement with the apertures in a side of said posts, and a plurality of wall panel elements having suspension means for engaging said carrier rods, said wall panel elements having a width larger than a distance between the posts so as when suspended to rest against outermost front side portions of its associated posts, and said wall panel elements having a height measured between their lower edges and their suspension means for engaging such that the wall panels are mounted in suspended positions with their lower edges located at or above a top side plane of underlying shelves.

2. A system according to claim 1, in which top edges of the wall panel elements are located flush with a rear edge of overlying shelves.

3. A system according to claim 1, further comprising: notches in lower edges of the wall panel elements.

4. A system for engaging according to claim 1, in which the suspension means for engaging are disposed above a top edge of the elements so that in their suspended positions the panel elements have their top edges in front of a lower area of associated transverse carrier rods, so that the associated transverse carrier rods are located behind any openings between the top edges of the panel elements and a lower end of overlying panel elements.

5. A system according to claim 1, in which front sides of the posts are provided with axially extending forwardly projecting flanges at two sides of a row of apertures which laterally support the wall panel elements.

6. A system according to claim 5, in which said flanges are wings mounted on angle iron elements, the wings covering outermost front side portions of the posts.

7. A system according to claim 6, in which the wings extend outwardly beyond the outermost front side portion beyond side edge of the posts.

8. A system according to claim 1, in which the posts, adjacent top ends thereof, have rearwardly projecting, telescopically adjustable distance members for connection with a rear mounting wall with the posts standing spaced from the wall.

* * * * *